US005358233A

United States Patent [19]

Ganter

[11] Patent Number: 5,358,233

[45] Date of Patent: Oct. 25, 1994

[54] SHEET DELIVERY IN A PRINTING MACHINE

[75] Inventor: Udo Ganter, Hirschberg-Leutershausen, Fed. Rep. of Germany

[73] Assignee: Heidelberger Druckmaschinen AG, Heidelberg, Fed. Rep. of Germany

[21] Appl. No.: 85,359

[22] Filed: Jun. 30, 1993

[30] Foreign Application Priority Data

Jul. 3, 1992 [DE] Fed. Rep. of Germany ..... 4221927

[51] Int. Cl.[5] ..... B65H 29/68

[52] U.S. Cl. ..... 271/183; 271/182

[58] Field of Search ..... 271/182, 183, 194, 196, 271/270

[56] References Cited

FOREIGN PATENT DOCUMENTS

| | | | |
|---|---|---|---|
| 1963712 | 7/1971 | Fed. Rep. of Germany | 271/183 |
| 2811963 | 9/1979 | Fed. Rep. of Germany | 271/183 |
| 2916251 | 10/1980 | Fed. Rep. of Germany . | |
| 3347178 | 7/1984 | Fed. Rep. of Germany . | |
| 940602 | 3/1944 | France | 271/183 |
| 662947 | 12/1957 | United Kingdom | 271/183 |
| 2132737 | 7/1984 | United Kingdom . | |

*Primary Examiner*—Robert P. Olszewski
*Assistant Examiner*—Carol L. Druzbick
*Attorney, Agent, or Firm*—Herbert L. Lerner; Laurence A. Greenberg

[57] ABSTRACT

A sheet delivery in a printing machine comprises a vacuum system for applying suction air and a sheet brake. The sheet brake is in the form of a brake roller which includes a carrier shaft having a longitudinal axis extending transversely to a sheet delivery direction. The carrier shaft includes a carrier pipe which communicates with the vacuum system. The carrier shaft has a control slit formed therein for the suction air. The control slit extends axially across the carrier pipe, corresponding approximately to a sheet width. A suction body pipe is coaxially supported on and surrounds the carrier pipe. The suction body pipe has a plurality of perforations formed therein and it is rotatably mouted on the suction body pipe. The suction body pipe is rotatably driven at a circumferential speed which is slower than a sheet delivery speed. Suction bodies are supported on the suction body pipe and they may be axially shifted thereon. The suction bodies are formed of radially assembled segments clamping the suction pipe. Bellows sealingly interconnect the suction bodies and seal the suction body pipe. Suction air is briefly applied to the suction nozzles in the sheet carrier surfaces of the suction bodies in phase with a working cycle of the sheet delivery.

10 Claims, 2 Drawing Sheets

SHEET DELIVERY IN A PRINTING MACHINE

BACKGROUND OF THE INVENTION

1. Field of the Invention

The invention relates to a sheet delivery at a printing machine with a sheet brake formed of a brake roller, in which suction bodies are axially shiftably disposed on a carrier shaft extending transversely to the sheet transport direction; the peripheral surfaces of the suction bodies define sheet carrier surfaces with suction nozzles formed therein, to which there is briefly applied suction air in phase with the working cycle of the machine; the suction bodies are driven via the carrier shaft at a circumferential speed which is slower than the sheet transport speed of the arriving sheets.

2. Description of the Related Art

The device disclosed in German Petty Patent DE-GM 84 30 170 defines the pertinent genus. Known therefrom is a two-part sheet brake at the chain delivery of a printing machine. The sheet brake is formed of rotating, disk-shaped suction bodies, which are disposed at an axial distance from one another on a carrier shaft. The carrier shaft extends transversely with respect to the sheet transport device in front of the sheet stack in the delivery. Suction air control heads are provided for each of the suction bodies.

The suction bodies are axially adjustably mounted on the carrier shaft. The braking action on the sheets to be deposited is effected by a circumferential speed of the suction bodies which is slower than the transport speed of the sheet. The suction bodies mutually form a brake roller. Set at a slight advance relative to the arriving sheet, they briefly attract and hold the sheet at the moment of its release from the grippers at the chain delivery. Due to this, the sheet can be stretched by the suction roller and it is lowered onto the sheet stack.

A further sheet delivery is known from German Patent Document DE 32 20 798 C1. A suction roller is effective as a sheet brake. Continuous bores are formed at the periphery of the roller. The bores are continuously distributed in a left or right oriented helically spiralling line. The bores are briefly connected to the suction air via suction air feed members in phase with the working cycle of the machine at a respectively correct instance. Such a configuration is only effective in connection with a pre-disposed table on which the sheet is lightly blown at with an air stream from below and is thus weighted against the table surface by suction due to a hydro-dynamic paradox.

A suction roller in the sheet delivery of a printing machine is known from German published, non-prosecuted application DE 41 16 510 A1, wherein suction bodies are disposed on the periphery of a suction air-conducting central pipe. The suction bodies are communicatingly connectible to the central pipe via suction air conduits. These components are housed in a suction tube with a plurality of openings in its periphery.

All of the prior art sheet deliveries have in common that the structural expense for the construction of the braking device and, most importantly, for the adjustment of the suction bodies is substantial. Additionally, control of the suction air is complicated and expensive. The required number of connection hoses for the suction air disturbs format changes, especially in machines for larger formats. The adaptation of the machines to different print materials, print formats and print images is complicated and time consuming. The use of trailing edge-capturing devices for the sheets is impaired, particularly in small-format machines.

SUMMARY OF THE INVENTION

It is accordingly an object of the invention to provide a sheet delivery in a printing machine, which overcomes the hereinafore-mentioned disadvantages of the heretofore-known devices of this general type and which provides a sheet brake for the delivery of a printing machine in a space-saving and much simpler fashion. It is another important object to improve the adaptability of the sheet deliverly to different printing materials, print formats and print images.

With the foregoing and other objects in view there is provided, in accordance with the invention, a sheet delivery in a printing machine in which sheets of a given sheet width are delivered in a given sheet delivery direction at a given sheet delivery speed, comprising a vacuum system for applying suction air; and a sheet brake in the form of a brake roller including a carrier shaft having a longitudinal axis extending transversely to a given sheet delivery direction; the carrier shaft including a carrier pipe, means for communicatingly connecting the carrier pipe to the vacuum system, the carrier pipe having a control slit formed therein for the suction air, the control slit extending axially across the carrier pipe and having a length approximately corresponding to a sheet width;

a suction body pipe coaxially supported on and surrounding the carrier pipe, the suction body pipe having a plurality of perforations formed therein, bearing means for rotatably mounting the suction body pipe on the carrier pipe, and drive means for rotatably driving the suction body pipe at a circumferential speed slower than a given sheet delivery speed;

suction bodies supported on the suction body pipe and being axially shiftable along the longitudinal axis; the suction bodies having peripheral surfaces forming sheet carrier surfaces with suction openings formed therein; the suction bodies being formed of radially assembled segments; and bellows sealingly inter-connecting the suction bodies and circumferentially surrounding the suction body pipe; and means for briefly applying suction air to the suction openings in the sheet carrier surfaces in accordance with a working cycle of the sheet delivery.

In accordance with an added feature of the invention, the bellows have ends for attachment to the suction bodies, and including complementary elements disposed on the ends and on the suction bodies for a non-rotatable connection therebetween.

In accordance with an additional feature of the invention, the suction body pipe has a peripheral surface and the suction bodies are non-rotatably mounted on the peripheral surface of the suction body pipe by means of friction seats.

In accordance with a further feature of the invention, the suction bodies are formed of mutually interconnected half-shell segments.

In accordance with again another feature of the invention, the brake roller of the sheet delivery includes sealing lip means disposed at edges defined around the control slit formed in the carrier pipe, the sealing lip means abutting against inner wall surfaces of the suction body pipe.

In accordance with again an added feature of the invention, the bellows include two outermost bellows, the outermost bellows each having an outer end tightly and rigidly connected with the suction body pipe.

In accordance with again an additional feature of the invention, the bellows are formed of a plurality of washer-like planar disks each having an inner and an outer edge, the inner edge of one of the planar disks being connected to the outer edge of an adjacent one of the planar disks.

In accordance with again a further feature of the invention, the planar disks of the bellows are connected with one another in a single piece.

Each bellows may be formed of planar disks and the disks are connected alternatingly at the outer and inner edges. Such a bellows has a relatively small volume and a long extension. Another advantage of such a bellows is its form stability and the possibility of an air-tight construction at only small expense. Disk-shaped front parts of the suction bodies are connected with the bellows. It is thereby possible to provide complementary elements for non-rotatably connecting to the ends to be connected to the suction bodies.

In accordance with a concomitant feature of the invention, the brake of the sheet delivery includes a support frame for supporting the carrier pipe, and means for phase-adjustably supporting the carrier pipe in the support frame.

In rephrasing the foregoing and referring to preferred embodiments of the invention, the carrier pipe with the control slit formed therein is mounted on two bearing blocks. The suction pipe, the peripheral surface of which is multiply perforated, is rotatably supported on the carrier pipe. The drive is disposed at one end for driving the suction bodies at a peripheral speed which is slower than the transport speed of the sheets in the chain delivery. The bellows and the suction bodies are mutually coaxially disposed on the suction pipe.

The suction bodies are formed of assembled segments, preferably half-shell segments which clamp about the suction body pipe. This leads to a considerable simplification in terms of the exchange of suction bodies for adaptation to different print materials, print formats and print images. The axial position of the suction bodies on the suction pipe is infinitely variable because the suction bodies are sufficiently non-rotatably attached on the periphery of the suction pipe by means of a friction fit. If necessary, it is also possible to provide a form lock, for instance a groove in the suction pipe and a nose on the suction body which meshes with the groove. No tools are necessary for exchanging or moving the suction bodies on the suction pipe. Particularly with this feature is it possible to continuously vary the position of the suction bodies in pressure-free spaces of the sheets to be printed.

The vacuum system is connected to the carrier pipe at only a single location. It can also be done from both face ends, however, so that the suction force can be increased. The carrier pipe is advantageously connected with the suction body pipe through a control opening provided with a sealing lip, so that a vacuum may be produced in the suction bodies in any arbitrary position, with which vacuum the sheet to be printed is aspirated onto the suction body.

All of the locations at which no suction body is placed are covered with the air-tight, axially shiftable bellows. The ends of the outer bellows can preferably be guided in a groove. During the printing operation the suction bodies and the bellows rotate with the suction body pipe. Since the control slit is stationary, a retention force is produced with the suction air only at a given location, namely in the vertical direction.

Other features which are considered as characteristic for the invention are set forth in the appended claims.

Although the invention is illustrated and described herein as embodied in a sheet delivery at a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 4 is a perspective, exploded view of the sheet brake.

DESCRIPTION OF THE PREFERRED EMBODIMENT

Figure 1:
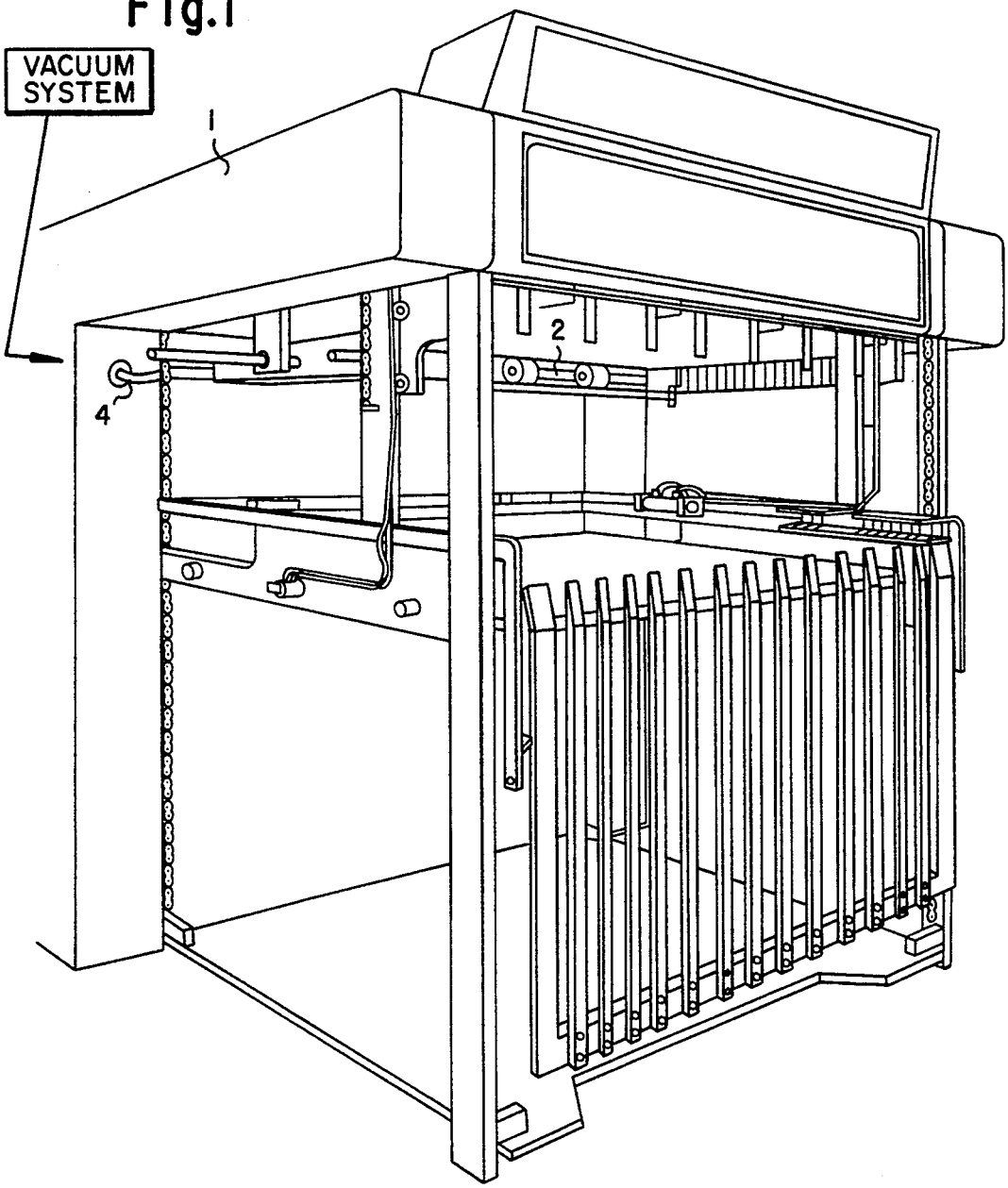
FIG. 1 is a perspective, schematic view of a sheet delivery of a printing machine.

Referring now to the figures of the drawing in detail and first, particularly, to FIG. 1 thereof, there is seen a sheet brake 2 disposed in a frame 1 of a sheet delivery of a printing machine. The sheet brake is disposed just in front of a sheet stack below the gripper bridges of a chain delivery. The grippers are not illustrated. Only those parts which are essential to the invention are illustrated. The longitudinal axis of the sheet brake 2 is oriented transversely to the delivery direction of the arriving sheets.

Figure 2:
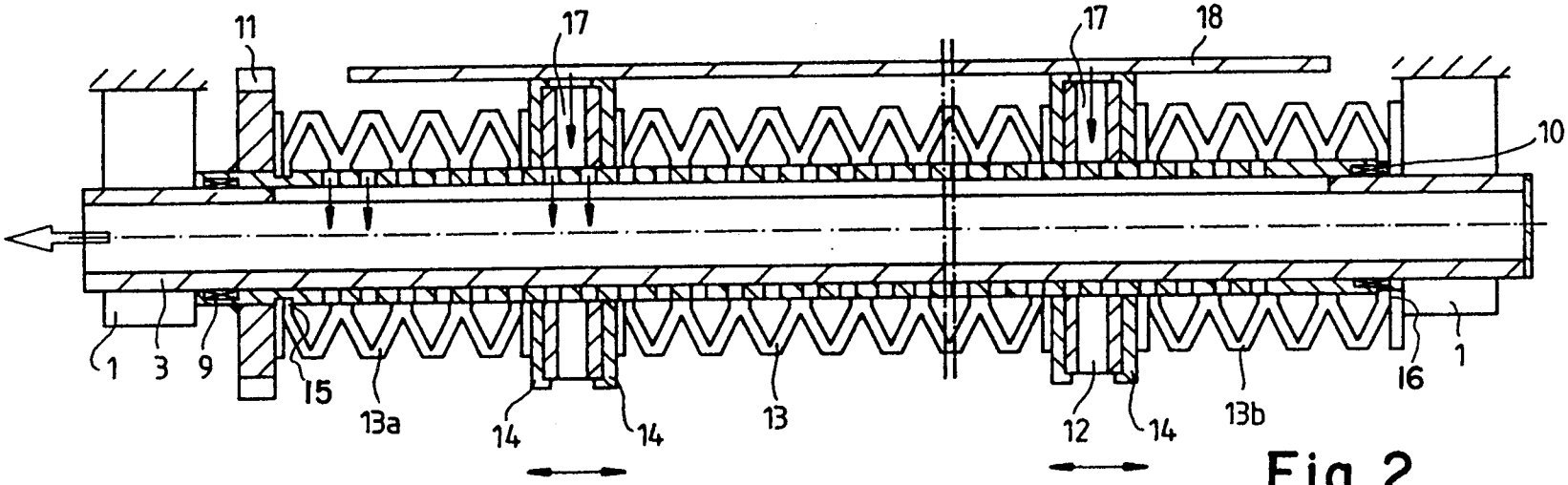
FIG. 2 is a longitudinal-sectional view through a sheet brake according to the invention.
Figure 3A:
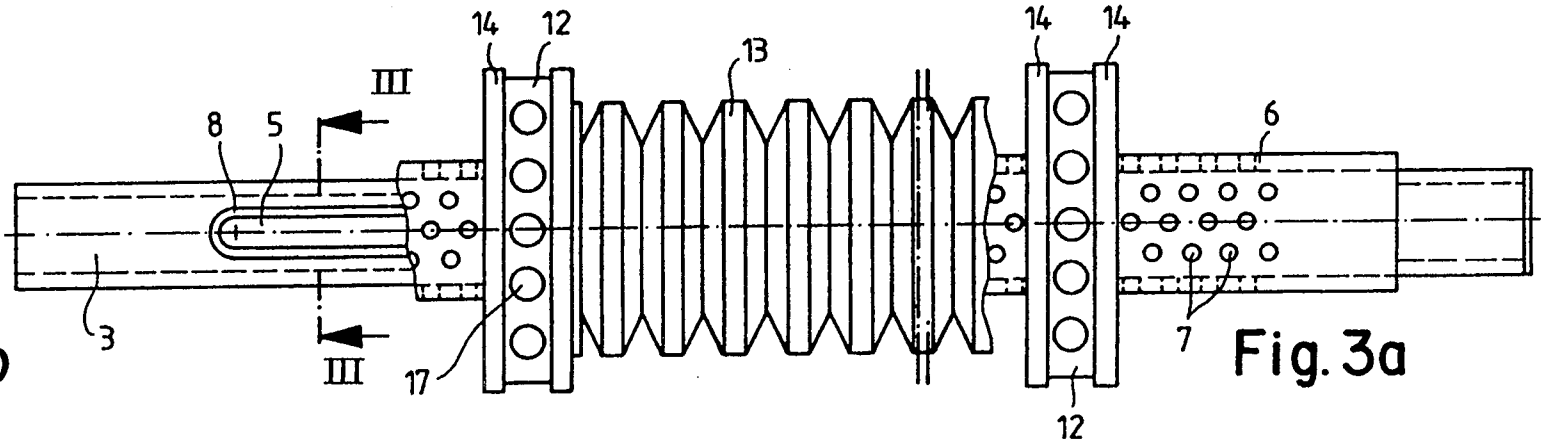
FIG. 3*a* is a side-elevational view of the sheet brake according to FIG. 2.
Figure 3B:
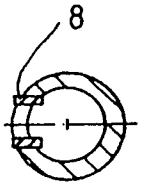
FIG. 3*b* is a cross-sectional view taken along the line III—III in FIG. 3*a*, viewed in the direction of the arrows.

Referring now in detail to the illustrations in FIGS. 2 to 4, the sheet brake 2 includes a carrier pipe 3. The ends of the carrier pipe 3 are rigidly supported in the frame 1 and an interior space of the pipe 3 communicates with the suction system or vacuum system of the machine. The communication is effected by a connector 4, as illustrated in FIG. 1. The carrier pipe 3 has a control slit or control opening 5 which extends approximately across the width of a maximum sheet format. The carrier pipe 5 carries a suction body pipe 6 which is rotatably mounted thereon. The suction pipe is perforated with a plurality of bores 7 across the length of the control slit 5. The perforations 7 are distributed about the entire circumference of the suction pipe body 6.

A sealing lip 8 of elastic material is disposed about the edges of the control slit 5. The lip 8 seals against the inner wall surfaces of the suction body pipe 6 and thus allows only those bores 7 of the perforation in the suction body pipe 6 which are aligned within the area of the control slit to become effective. The ends of the suction body pipe 6 are rotatably mounted by means of bearings 9 and 10 on the carrier pipe 3. The suction pipe 6 is axially stationary with regard to the carrier pipe 3 and thus with regard to the frame 1. The rotatable suction body pipe 6 is driven by a non-illustrated machine drive via a wheel 11, for instance a chain sprocket wheel, a toothed gear or the like. The wheel 11 is mounted at one end of the suction body pipe 6.

Disk-shaped suction bodies 12 are supported on the suction body pipe 6. The suction bodies 12 are axially movable along the suction body pipe 6, i.e. coaxially with the longitudinal axis of the carrier pipe 3. The suction bodies 12 are distributed at predetermined mutual spacings along the suction body pipe 6. Bellows 13 are disposed between each pair of suction bodies 12. Ends of the bellows 13 are sealingly attached to the suction bodies 12. The outermost ends of the two outer bellows 13*a* and 13*b* are tightly connected at the suction body pipe 6.

Each suction body 12 is formed of at least two radially assembled segments 12*a* and 12*b*, as is illustrated in FIG. 4. In other words, the two segments 12*a* and 12*b* are provided with mating connectors which allows the same to be inserted into each other in mutually opposing radial directions as seen with respect to the longitudinal axis of the pipes 3 and 6. For the purpose of providing a tight connection of the ends of a bellows 13 with the suction body 12, disks 14 are connected at the ends of the bellows 13 and complementary interconnected elements are provided at the touching surfaces of the disks 14 and the suction bodies 12. The elements prevent the bellows 13 from rotating relative to the suction bodies 12, i.e. they effect a rotation-free connection of the bellows with the suction body.

Under usual circumstances it will suffice to hold the suction bodies 12 at the periphery of the suction body pipe 6 by means of a frictional lock, i.e. a force-lock, in order to prevent their rotation. This makes it possible, by axially shifting the suction bodies 12 along the suction body pipe 6, to offer infinitely variable axial adjustments for optimal adaptation to the printed product. A torsionless coupling between the suction pipe 6 and the suction body 12 by means of a form-lock is thereby not excluded. It is noted, in this context, that a force-locking connection is one which connects two elements together by force external to the elements, as opposed to a form-locking connection which is provided by the shapes of the elements themselves.

The construction of the suction bodies 12 from radially assembled segments (12*a*, 12*b*, for instance) makes a quick exchange of the suction bodies possible for an adaptation of the delivery to different materials to be printed, to different print formats, print images and the like. In the case of smaller formats, the outer half-shell 12*a*, 12*b* can also be exchanged against one without transverse bores. As already mentioned, the connection and quick assembly of the segments 12*a* and 12*b* is aided by complementary elements of a conventional kind which effect a sufficiently rigid connection of the segments. The outer ends of the outer bellows 13*a* and 13*b*, in the exemplary embodiment, are tightly mounted in annularly surrounding grooves 15 and 16 formed in the peripheral surface at the ends of the suction body pipe 6.

In accordance with a special feature of the invention, the bellows 13 are constructed from planar disks in the form of washers. Adjacent disks are thereby connected to one another with the elastic bellows material between an inner edge of one disk to an outer edge of the other disk. This provides superior axial expandibility with relatively small volume and mass requirements. The inner edges of the disks can also be used as support surfaces for the bellows 13 on the pipe.

The vacuum suction present in the carrier pipe 3, as caused by its communication with the machine vacuum system through the connector 4, can therefore become effective through the control slit 5 only in the region of the control slit 5 in the radially extending, aligned suction air openings 17 of the suction bodies 12. The vacuum suction causes the sheet 18 to adhere. The suction air is therefore only effective at the upper side of the suction bodies 12 for a short time. The sheet is attracted and slowed down to a speed which corresponds to the linear velocity tangential at the periphery of the suction bodies 12, at the sheet carrier surfaces. That tangential velocity, which is herein referred to as the peripheral speed or peripheral velocity, is slower than the transport speed of the sheet.

As conventionally done, this slowing action may also be accompanied by a stretching/smoothing of the sheet, in that the suction air in the suction bodies is released slightly early with respect to the release of the sheet from the grippers at the gripper bars of the chain delivery in the delivery. In other words, the suction is started slightly out of phase. For the purpose of allowing adjustment of the suction timing, the carrier pipe 3 can be phase-adjustably supported in its bearing in the frame 1.

The configuration of the suction bodies shown in the drawing is but exemplary. The suction bodies may be adapted in a known manner to any type of print material, to the print image and other requirements.

I claim:

1. A sheet delivery in a printing machine in which sheets of a given sheet width are delivered in a given sheet delivery direction at a given sheet delivery speed, comprising a vacuum system for applying suction air;

a sheet brake in the form of a brake roller including a carrier shaft having a longitudinal axis extending transversely to a given sheet delivery direction; said carrier shaft including a non-rotatably supported carrier pipe, means for communicatingly connecting said carrier pipe to said vacuum system, said carrier pipe having a control slit formed therein for the suction air, said control slit extending axially across said carrier pipe and having a length approximately corresponding to the given sheet width;

a suction body pipe coaxially supported on and surrounding said carrier pipe, said suction body pipe having a multiplicity of perforations formed therein, bearing means for rotatably mounting said suction body pipe on said carrier pipe, and drive means for rotatably driving said suction body pipe at a circumferential speed slower than the given sheet delivery speed;

suction bodies supported on said suction body pipe and being axially shiftable along said longitudinal axis; said suction bodies having peripheral surfaces forming sheet carrier surfaces with suction openings formed therein; said suction bodies being formed of radially assembled segments; and bellows sealingly interconnecting said suction bodies and circumferentially surrounding said suction body pipe; and means for briefly applying suction air to said suction openings in said sheet carrier surfaces in accordance with a working cycle of the sheet delivery.

2. The sheet delivery according to claim 1, wherein said bellows have ends for attachment to said suction bodies, and including complementary elements disposed on said ends and on said suction bodies for a non-rotatable connection therebetween.

3. The sheet delivery according to claim 1, wherein said suction body pipe has a peripheral surface and said suction bodies are non-rotatably mounted on said peripheral surface of said suction body pipe by means of friction seats.

4. The sheet delivery according to claim 1, wherein said suction bodies are formed of mutually interconnected half-shell segments.

5. The sheet delivery according to claim 1, including sealing lip means disposed at edges defined around said control slit formed in said carrier pipe, said sealing lip means abutting against inner wall surfaces of said suction body pipe.

6. The sheet delivery according to claim 1, wherein said bellows include two outermost bellows, said outermost bellows each having an outer end tightly and rigidly connected with said suction body pipe.

7. The sheet delivery according to claim 1, wherein said bellows are formed of a plurality of washer-like planar disks each having an inner and an outer edge, said inner edge of one of said planar disks being connected to said outer edge of an adjacent one of said planar disks.

8. The sheet delivery according to claim 7, wherein said planar disks of said bellows are connected with one another in a single piece.

9. The sheet delivery according to claim 1, including a support frame for supporting said carrier pipe, and means for phase-adjustably supporting said carrier pipe in said support frame.

10. A sheet delivery in a printing machine in which sheets of a given sheet width are delivered in a given sheet delivery direction at a given sheet delivery speed, comprising a vacuum system for applying suction air; a sheet brake for slowing sheets arriving at the sheet delivery from the given sheet delivery speed to a relatively slower speed, said sheet brake including a carrier shaft having a longitudinal axis extending transversely to the given sheet delivery direction; a stationary carrier pipe communicating with said vacuum system, said carrier pipe having a control slit formed therein for the suction air, said control slit extending axially across said carrier pipe; a suction body pipe coaxially and rotatably supported on said carrier pipe, said suction body pipe having a multiplicity of air nozzles formed therein, drive means for rotatably driving said suction body pipe at a circumferential speed slower than the given sheet delivery speed; suction bodies supported on said suction body pipe and being axially shiftable along said longitudinal axis; said suction bodies having peripheral surfaces forming sheet carrier surfaces with suction openings formed therein; and bellows means for sealing said sheet brake and allowing suction air to be applied only through said suction openings formed in said sheet carrier surfaces.

* * * * *